US012053036B2

(12) United States Patent
Nidam

(10) Patent No.: US 12,053,036 B2
(45) Date of Patent: Aug. 6, 2024

(54) INFLATABLE ITEM

(71) Applicant: THERMOGEAR LTD, Kfar Hanagid (IL)

(72) Inventor: Ofer Nidam, Kfar Hanagid (IL)

(73) Assignee: THERMOGEAR LTD., Klar Hanagid (IL)

( * ) Notice: Subject to any disclaimer, the term of this patent is extended or adjusted under 35 U.S.C. 154(b) by 213 days.

(21) Appl. No.: 17/637,626

(22) PCT Filed: Jul. 13, 2020

(86) PCT No.: PCT/IL2020/050784
§ 371 (c)(1),
(2) Date: Feb. 23, 2022

(87) PCT Pub. No.: WO2021/038553
PCT Pub. Date: Mar. 4, 2021

(65) Prior Publication Data

US 2022/0273052 A1 Sep. 1, 2022

(30) Foreign Application Priority Data

Aug. 29, 2019 (IL) ..... 268998

(51) Int. Cl.
*A41D 13/002* (2006.01)
*A41D 13/005* (2006.01)
(Continued)

(52) U.S. Cl.
CPC ..... *A41D 13/0025* (2013.01); *A41D 13/005* (2013.01); *A41D 13/018* (2013.01);
(Continued)

(58) Field of Classification Search
CPC ..... A41D 13/0025; A41D 13/005; A41D 13/018; A41D 13/002; A41D 31/065;
(Continued)

(56) References Cited

U.S. PATENT DOCUMENTS 3,713,480 A * 1/1973 Low ..... A41D 13/0025 165/46
5,063,923 A * 11/1991 Peroni ..... A41D 13/0025 128/202.19

(Continued)

FOREIGN PATENT DOCUMENTS

CN 208573056 U 3/2019
CN 109770644 A 5/2019
DE 20310896 U 12/2003

OTHER PUBLICATIONS

International Search Report for PCT/IL2020/050784, mailed Oct. 22, 2020 (8 pages).

(Continued)

*Primary Examiner* — Minh Q Le
(74) *Attorney, Agent, or Firm* — Roach Brown McCarthy & Gruber, P.C.; Kevin D. McCarthy

(57) ABSTRACT

The invention describes an inflatable item comprising one or more cells with a padding material, being inflatable and/or deflatable by controllably changing volume of air accumulated in said padded cells, so as to regulate a thermal insulating property of the cells. The invention further relates to techniques for providing and controlling of such an item.

18 Claims, 6 Drawing Sheets

(51) Int. Cl.

| | |
|---|---|
| ***A41D 13/018*** | (2006.01) |
| ***A41D 31/06*** | (2019.01) |
| *A41B 1/08* | (2006.01) |
| *A41D 1/00* | (2018.01) |
| *A41D 1/04* | (2006.01) |
| *A41D 27/28* | (2006.01) |
| *B63C 9/125* | (2006.01) |

(52) U.S. Cl.
CPC ..... *A41D 31/065* (2019.02); *A41B 1/08* (2013.01); *A41D 1/002* (2013.01); *A41D 1/04* (2013.01); *A41D 13/002* (2013.01); *A41D 27/28* (2013.01); *B63C 9/1255* (2013.01)

(58) Field of Classification Search
CPC ..... A41D 1/002; A41D 1/04; A41D 27/28; A41B 1/08; B63C 9/1255
USPC ..... 137/1
See application file for complete search history.

(56) References Cited

U.S. PATENT DOCUMENTS 5,148,002 A * 9/1992 Kuo ..... H01Q 1/273 219/549
6,823,678 B1 * 11/2004 Li ..... F25B 21/04 62/3.5
11,432,597 B2 * 9/2022 Temeng ..... A41D 13/0025
11,857,004 B2 * 1/2024 Cauchy ..... H10N 10/13
2002/0111777 A1 8/2002 David
2004/0183283 A1 9/2004 Buckman et al.
2006/0046024 A1 * 3/2006 Huntley ..... B32B 5/145 112/440
2009/0230112 A1 9/2009 Ducharme et al.
2010/0167608 A1 7/2010 Daye et al.
2013/0178146 A1 * 7/2013 Stockett ..... A41D 31/102 454/339
2015/0250420 A1 9/2015 Longinotti-Buitoni et al.
2017/0295860 A1 10/2017 Hall et al.
2018/0110266 A1 * 4/2018 Lee ..... A41D 13/0025
2018/0184735 A1 * 7/2018 Longinotti-Buitoni ..... A61B 5/282
2018/0317572 A1 * 11/2018 Guttman ..... A41D 27/28
2020/0046050 A1 * 2/2020 Rusch ..... A41D 13/0025
2020/0345087 A1 * 11/2020 Conti Filho ..... F25B 19/00
2021/0000195 A1 * 1/2021 Temeng ..... A41D 13/0053
2021/0241125 A1 * 8/2021 Jost ..... G06N 20/10
2022/0168495 A1 * 6/2022 Locke ..... A61H 9/0092
2022/0346470 A1 * 11/2022 Temeng ..... A41D 13/0025
2023/0024924 A1 * 1/2023 Okugawa ..... A41D 31/145

OTHER PUBLICATIONS

Written Opinion of the International Searching Authority for PCT/IL2020/050784, mailed Oct. 22, 2020 (6 pages).

* cited by examiner

INFLATABLE ITEM

FIELD OF THE INVENTION

The present invention belongs to the field of inflatable items, for example garments such as coats, vests and the like, or other inflatable items which may serve for heat insulation.

BACKGROUND OF THE INVENTION

A variety of presently known inflatable items include bags, garments, mattresses and the like, which have empty chambers intended for buoyancy, for protecting the user in case of accidents, for thermal insulation etc.

Such items are usually stiff when fully inflated. When non-inflated or half-inflated, such items do not provide the desired action since the mentioned chambers, incompletely filled with air, become easily deformable and non-uniform.

Conventional garments intended for heat insulation comprise, inter alia, various coats and other clothing provided with padding (for example, with layers of clothing, feathers filling, down, hollow fiber etc.)

Both of the above-mentioned groups of garments are hardly adaptable to the user's needs when the weather/season changes, since they have a fixed level of temperature insulation.

It is well known, that any garment (be it inflatable or not) has its specific range of temperatures or a specific season to which it suits. In practice, even when a user selects a suitable garment for a specific season, the changing weather may cause the user to intermittently put on and take off the garment during one day, since there is no other way to adapt himself/herself to the changing temperature/wind.

Some attempts were reported in the art to provide more adaptable clothing.

DE 20310896U describes a garment that can be cooled through air pipe and/or air chamber system, which sucks outside air and distributes air on a body in the garment interior. The air pipe and/or air chamber system of the garment consists of air conductor tracks which form a hollow space. The air, sucked in by a ventilator, is transported through the hollow space to defined air exit sites, at which the air is distributed on the body. The air pipe and/or chamber systems can be applied on the garment inside by various ways: sewing, welding, clamping, gluing, laminating, weaving or knitting.

CN208573056U describes a multi-layer inflatable raincoat comprising an inflatable bladder/balloon with an air intake valve, which provides an anti-rain effect and a warm effect.

Still, every specific user has his/her own conditions of thermal comfort, so the problem requires developing of new solutions.

To the best of the Applicant's knowledge, there is no such a concept in the prior art, which would technologically enable an item/a garment with a heat insulation property both controllable in a wide range, and individually adaptable.

OBJECT AND SUMMARY OF THE INVENTION

It is therefore an object of the invention to propose an improved, new item (for example, a new garment) with a heat insulation property controllable in quite a broad range, so as to be suitable for various thermal conditions or seasons.

Another object of the invention is to provide such an item with individually adaptable and easily controllable heat insulation.

A more specific object of the invention is to provide such an item adapted to control its heat insulation by taking into consideration one or more factors, for example: weather conditions outside the garment, temperature and/or humidity inside the garment (i.e. between a supposed user and the garment), some individual readings and settings (pulse, indication of movement/physical exercises, threshold values introducible for/by a specific user), etc.

The above object may be achieved by providing an inflatable item comprising one or more cells (chambers, pockets) containing a padding material, wherein the item is controllably inflatable and/or deflatable by controllably changing volume of air accumulated in said padded cells (i.e., within the padding material), so as to regulate a thermal insulating property of the cells.

In the frame of the present patent application, the term "item" should be understood as a general term covering garments (clothing, headwear, footwear such as coats, vests, pants, overalls, hats, gloves, scarfs, socks, boots etc.), other articles for keeping a user in temperature comfort indoors or outdoors (blankets, mattresses, sleeping sacks, tents and the like, etc.), and portions/elements of such garments or articles.

The terms "item", "garment", "item/garment", "inflatable item", "inflatable garment" "inflatable item/garment" will therefore be intermittently and interchangeably used in the description and the claims.

The proposed inflatable item (for example, garment) should have at least one air valve to allow inflation and/or deflation of the item via said valve.

For example, a one-way valve may assist inflating the garment, while deflation (if required) may be provided manually (just by pressing the garment thus evacuating the air via multiple existing air channels and pores in the seams etc.).

In another example, deflating and inflating can be done manually using one-way valves.

Said at least one valve may be capable of transferring air in both ways. In one embodiment, one so-called two-way valve may be provided.

In another embodiment, the item/garment may have two valves—for example two one-way valves:

- a first one-way valve for inflating the garment (even directly/orally by a user), and for simultaneously preventing the inflated air from coming out from the garment;
- a second one-way valve for deflating the garment. The air previously accumulated in the garment may be discharged through the second valve just by opening it (manually or automatically), while the outside air will be prevented from coming back to the garment. If there is some excessive internal air pressure in the pockets, it will be reduced when extra air leaves the garment via the valve. It goes without saying that excessive air may be expelled from the garment more effectively when pressing the garment manually. Anyway, if the internal pressure in the pockets is not higher than outside, additional means may be needed to evacuate the air via the valve.

The item/garment may be inflated/deflated by a controllable air pump (air blower, fan etc.). The air pump may be controlled manually or automatically.

A single air pump may work both ways.

However, one or more pumps may be provided, and may be connected to different valves in the garment.

Such different valves may be placed in different areas of the garment.

The controllable air-pump may be provided and connected to any of said air valves so as to enhance the air inflation and/or the air deflation of said item/garment.

In one embodiment, the air pump may be reversible/working both ways (i.e., capable of selectively pumping air in any of two opposite directions, so as to perform either inflation or deflation of the garment, as needed).

In another version, two air pumps may be respectively connected to the two air valves, so that one air pump serves for inflating the garment, while the other air pump serves of deflating the garment.

It is known that air is a good heat insulating medium. It is also known that an item (for example a pillow) filled with padding materials like feathers or hollow-fiber may hold a lot of air if the air gets into the item, and may return to its minimal volume when the air is pressed out from the item. However, nobody thought about regulating heat insulation by regulating volume of padding substances with air.

In the frame of the proposed solution, the padding material should be understood as being any natural or artificial fiber, foam or flock comprising substance which is capable of changing its volume: expanding when accumulating air, and shrinking when the air is evacuated from the substance.

For example, the padding material may comprise one or more of the following: any fiber-like material, for example natural or artificial down, plume, feathers, hollow fiber, natural fabric flock, artificial flock, natural or artificial foam, etc.

Since the padded cell changes its thermal insulation property depending on amount of air introduced in the padding material, the proposed inflatable item/garment becomes adjustable to a wider range of outside temperatures, than a similar padded but non-inflatable item/garment.

The proposed inflatable item/garment thereby becomes a universal one which is capable of keeping the user in thermal comfort during any season: cool summer, spring/autumn and even in winter. Such an item—being it a tent, a coat, a footwear or a sleeping sack—is irreplaceable for travels.

Further, the item/garment may be provided with a control unit and be controllable by it. Preferably, the control unit is embedded in the item/garment.

In another embodiment, the control unit may be placed in a remote control unit designed for the item/garment, be implemented in a computer application (for example, in a mobile application) or be distributed between the item/garment and the remote control unit.

The control unit may be adapted to control at least said air valve (or said air valves).

As already mentioned, for artificially inflating and/or deflating the item/garment, it may comprise at least one embedded controllable air pump. The pump(s) may be controlled by a control unit, all of them may be fed by a battery.

Both the valve(s) and the air pump(s) of the item/garment may be controlled by the control unit.

Further, the inflatable item/garment may be provided with air channels for conveying air to and/or from the padded cells. The air channels may connect the air valve/s and/or the air pump(s) with said cells.

The air channels are preferably hermetical, but may be not.

Cells themselves may be non-hermetic. Hermetic cover of the cells is preferable for items/garments intended for autumn and winter.

However, hermetic seams may be provided in the item/garment, for example between the cells.

In one embodiment, the hermetic seams may be associated with the hermetic air channels (for example, may adjoin the channels or even be combined with them).

The proposed item/garment may be provided with orifices for evacuating humid air outside, from a space between the item and a supposed user, to keep the user in a dry atmosphere.

For example, such orifices may be located in the seams provided in the garment.

In another embodiment, the seams may be hermetic to the surrounding while open to air movement from cell to cell It is important to understand and emphasize, that the seams may be:

- hermetic or not hermetic to the surrounding (i.e., may provide air exchange in the direction which is generally perpendicular to the garment's surface: from the user's body to the atmosphere and back, via suitable orifices in the seams);
- hermetic or not hermetic for neighboring cells (i.e., may provide air exchange between cells located in the neighboring rows and/or columns of the garment, via gaps/orifices in the seams in directions generally parallel to the garment's surface)

Any combinations of hermetic and non-hermetic seams are possible in one and the same garment and, naturally, in different garments.

The inflatable item/garment may be further provided with one or more air filters (air diffusers) for preventing expel of the fiber-like material from the cells.

The air filters may be placed, for example, between the air channels and the padded cells, to prevent clogging of the air channels with the fiber-like material from the cells.

The controlled air inflation/deflation of the item/garment may be performed by the air pump, as desired by the user or according to signals received from the control unit.

As mentioned, the air pump may be controlled by a user, for example manually.

Still more specifically, the air pump may be controllable by a control system (unit).

The control system/unit may be adapted for receiving one or more readings, parameters and/or indications, for example:

- readings of inside temperature (i.e., temperature between the garment and a supposed user) , readings of inside humidity, user's pulse, indications of the user's movement/exercises, and predetermined threshold readings/parameters/indications (i.e., a default temperature or the user's preferred temperature, inside humidity, regular pulse, regular indications of physical activity), and for processing
- said readings/parameters/indications so as to issue control signals (for example, to a one-way valve, to an embedded air pump or both) for inflating or deflating the item/garment, in order to control the heat insulation.

Of course, data on outside conditions (readings of outside temperature, wind, atmospheric pressure, humidity etc.) may also be taken into account.

For example, the control system (unit) may additionally receive and process readings of inside and/or outside humidity. The control system may also monitor readings of air pressure in the item/garment cells. It is understood that, for example, when the temperature inside the garment is too high, the user may start sweating. It has also been noted, that when the user's pulse increases (due to some emotions or due to physical activity), the inside temperature and the inside humidity may also increase. These factors may be used for controlling the air pump so as to adapt the thermal insulation accordingly, and even in advance.

All the mentioned readings may be supplied to the control unit by sensors of temperature and optional sensor(s) of humidity, of the user's pulse, of the user's physical activity, of air pressure in the cells, etc. Readings of outside conditions may be received from sensors positioned on the garment and/or from outside sources, for example such as the Internet or a Cloud server, Smart phone, Smart watch etc.

The control system may be arranged in multiple ways.

In the simplest case, when the garment comprises only one air valve which is responsible for inflating and/or deflating the garment, means putting the valve in one or another position and controllable by the user may be considered as the simplest implementation of the control system (unit). The air valve(s) may be controlled, for example, via air pump(s), if installed in the garment. In the most basic case, the air valve may be activated by the user even by blowing the garment.

In another embodiment, the control system may comprise a controller embedded in the garment for collecting data from one or more sensors in the garment and/or from the user, processing the data and for suitably controlling one or more air valves installed in the garment for its inflation and/or deflation. The control may be implemented via one or more respective air pumps installed in the garment.

In a further embodiment of the control system, the embedded controller may be remotely controlled by a mobile phone application and/or by one or more connected units (for example, a smart watch). It should be noted that the mobile phone application and/or the smart watch may collect data from various inside and outside sensors, process the data and be monitored and controlled by the user. For example, the mentioned entities may allow: displaying some information to the user, updating parameters by the user, introducing commands by the user, etc.

In yet another embodiment of the control system it may comprise a remote server (for example, a Cloud server) which may be interconnected directly or indirectly with one or more of the above-mentioned entities: embedded controller, mobile phone application, smart watch, etc. and even with various sensors for collecting data and the user's adjustments and commands, processing the collected information and controlling the garment based on the processed information.

According to a second aspect of the invention, there is also provided a method for regulating a thermal insulating property of an item comprising one or more cells (chambers, pockets) containing a padding material, the method including controllably inflating and/or deflating the item by controllably changing volume of air accumulated in said one or more padded cells.

As mentioned earlier with reference to the term "item", it should be understood as a general term covering garments (clothing, headwear, footwear such as coats, vests, pants, overalls, hats, gloves, scarfs, socks, boots etc.), other articles for keeping a user in temperature comfort indoors or outdoors (blankets, mattresses, sleeping sacks, tents and the like, etc.) and portions/elements thereof.

Specific details disclosed above with respect to the proposed item may be applied to the proposed method mutatis mutandis.

It goes without saying that any inflating/deflating operations in the proposed item should be controlled so as to provide the air pressure in the cells within a reasonable (or a predetermined) range.

According to a further aspect of the invention, there is provided a software product comprising computer implementable instructions and/or data for carrying out the method described above, stored on an appropriate non-transitory computer readable storage medium so that the software is capable of enabling operations of said method when used in a computerized system.

The software product may be part of the control system, for example be integrated in one or more of the mentioned entities: a mobile application, a smart watch, a controller (a microprocessor) embedded in the item/garment, which together may form the computerized system. The computerized system will thus comprise the garment with its valve/s and air pump/s. The software product may incorporate elements of Artificial Intelligence (AI) and/or Internet of Things (IoT). However, elements of AI may be created during deep learning due to interaction of the software product with the user, a plurality of connected devices, Cloud memory, etc.

There is also provided a computer readable storage medium for storing the software product as described above.

The invention will be further described in detail as the description progresses.

BRIEF DESCRIPTION OF THE DRAWINGS

The invention will be further described and illustrated with the aid of the following non-limiting drawings, in which.

DETAILED DESCRIPTION OF SPECIFIC EMBODIMENTS

Figure 1:
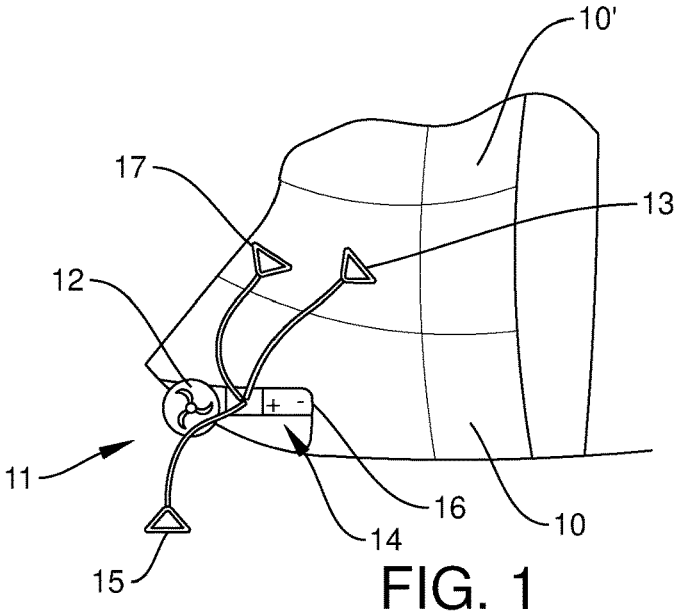
FIG. 1 illustrates one possible arrangement of the proposed inflatable item in the form of a garment.

FIG. 1 shows one example 10 of the proposed item (say, a coat or a vest with padded cells 10'), which is provided with an inflating/deflating unit 11 embedded in a lower corner of the garment.

The inflating/deflating unit 11 may comprise just at least one air valve (not shown, though present). The air valve is needed to create/preserve a pressure difference between the cells (pockets) of the garment and the outside. The valve(s) may be controlled by a user directly, or by a control unit (14).

The inflating unit is connected to the padded cells 10' via air channels (not shown in this drawing).

The padding may be a fiber-like, a flock-like, may be a porous material and the like which comprises air there-inside.

In this drawing, the unit 11 is shown as also comprising an air pump (a fan, an air blower) 12 operated by the control unit 14 (for example, a microcontroller with embedded software). The inflating/deflating unit 11, including the pump 12 and the control unit 14, is powered by a battery 16.

The control unit (system) 14 may be in communication with a group of temperature sensors (shown here as triangles 13 and 15), which may be located at various points of the garment and measure the current inside temperature (sensor 13) and the current outside temperature (sensor 15). A sensor 17 for measuring inside humidity may also be provided, to supply the control unit 14 with readings of humidity accumulated under the garment.

The controller 14 may adjust the air saturation within the air cells of the garment to change the level of thermal insulation and thus to accommodate it to the user's needs.

Users' settings such as desired thresholds of temperature may be introduced in the controller 14. Manufacturers' settings such as the maximal allowed air pressure in the padded cells may be entered in the controller in advance.

Any default temperature regime may be set in advance in the control unit 14.

Alternatively or in addition, the controller 14, in cooperation with sensors, may measure and learn temperature preferences of the user and take them into account for creating a preferred individual regime controlling the air intake/air suction.

A user may utilize an interface (embedded in 14, or a remote control unit) for communication with the controller 14. Such an interface may be in the form of a mobile application (not shown) in order to communicate with the controller 14 (for example to enter into the controller the temperature value under the garment, preferred by the user, the maximal allowed air pressure in the cells, etc.)

In alternative embodiments, the controller 14 may be in the form of a control software pre-programmed in the mentioned mobile application, or the control software of the controller 14 may be located in a separate remote control unit specifically designed for the garment.

Still further, the controller 14 may be partially located in the garment, and partially in the interface (control unit or mobile application).

The sensor for humidity measurement may also assist in creating the preferred regime and adjusting the insulation level of the cells, since when a person feels too hot, he/she begins to sweat.

When the inside conditions drift from some preferred regime (or from the default regime), all the device 11 needs to do is to remove some air from the garment or let it back in. Any of these operations can be performed by controllably opening the valve(s) and letting the pressure difference inside and outside the garment work.

As discussed above, the pressure in the pockets/cells of the garment may be higher, lower or equal to the surrounding pressure. Therefore, letting the air in or out can be done by opening the valve(s).

In addition, the air pump 12 may be activated to facilitate letting the air in or out of the cells.

All the above operations can be done either by the user according to his/her own decision, or be controlled by a control unit 14 which in turn may be operated by the user, by a software product and/or by AI.

Figure 2:
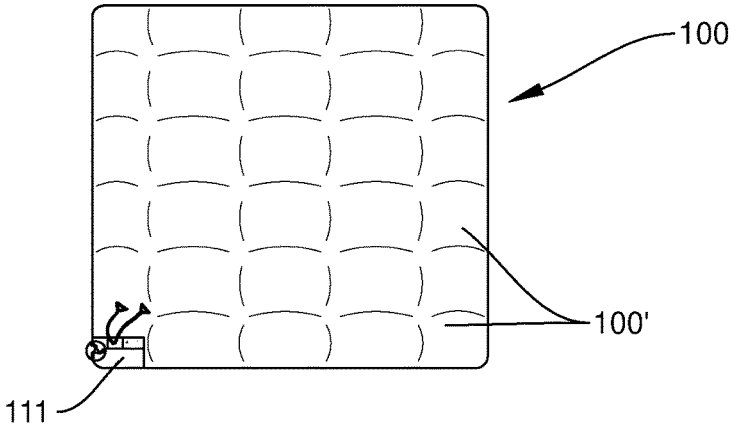
FIG. 2 illustrates another embodiment of the proposed item (being a blanket, a scarf, a tent's wall portion, etc.), which is preferably provided with a control unit, sensors and an air pump.

FIG. 2 illustrates an embodiment where the inflatable item 100 is in the form similar to a blanket, has one or more padded cells 100' and is provided with inflating/deflating unit 111. The inflating/deflating unit 111 is connected to the padded cells 100' via air channels (not shown in this drawing).

Alternatively, the item 100 may be a wall portion of a tent or of another construction, in which construction the item 100 may be embedded so as to communicate with the atmosphere. Item 100 will thus be adapted to controllably change the heat insulating property of the construction. The unit 111 may be provided with one or more of the mentioned sensors, may be controlled remotely by the user and/or or be self-controlled.

Figure 3:
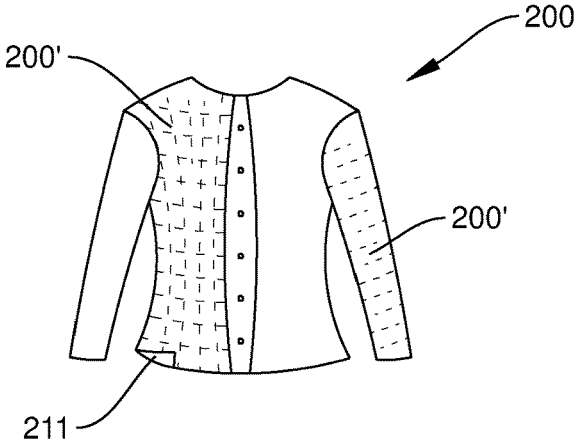
FIG. 3 illustrates yet another embodiment of the proposed item in the form of a coat.

FIG. 3 shows yet another embodiment 200 of the inflatable item in the form of a jacket. The jacket is similar to the popular and light ones, which have padding cells 200' filled with down.

The inflating/deflating unit 211 may be embedded at the lower portion of the garment.

It should be noted that the cells 10', 100', 200' of the respective items 10, 100, 200 may be arranged in columns and rows, and be connected to one another in series and/or in parallel by air channels (not shown). For example, in FIG. 3 the padded cells 200' of the item 200 are arranged in vertical columns and connected in series by air channels. It should be noted that the cells may be arranged in rows/columns and be oriented in any direction. Alternatively or in addition to being connected in series, the cells may also be connected in parallel, i.e. may form one or more mutually interconnected rows/columns. This may be implemented by using seams 25 comprising gaps 27 which interconnect parallel cells (see FIG. 4).

Figure 4:
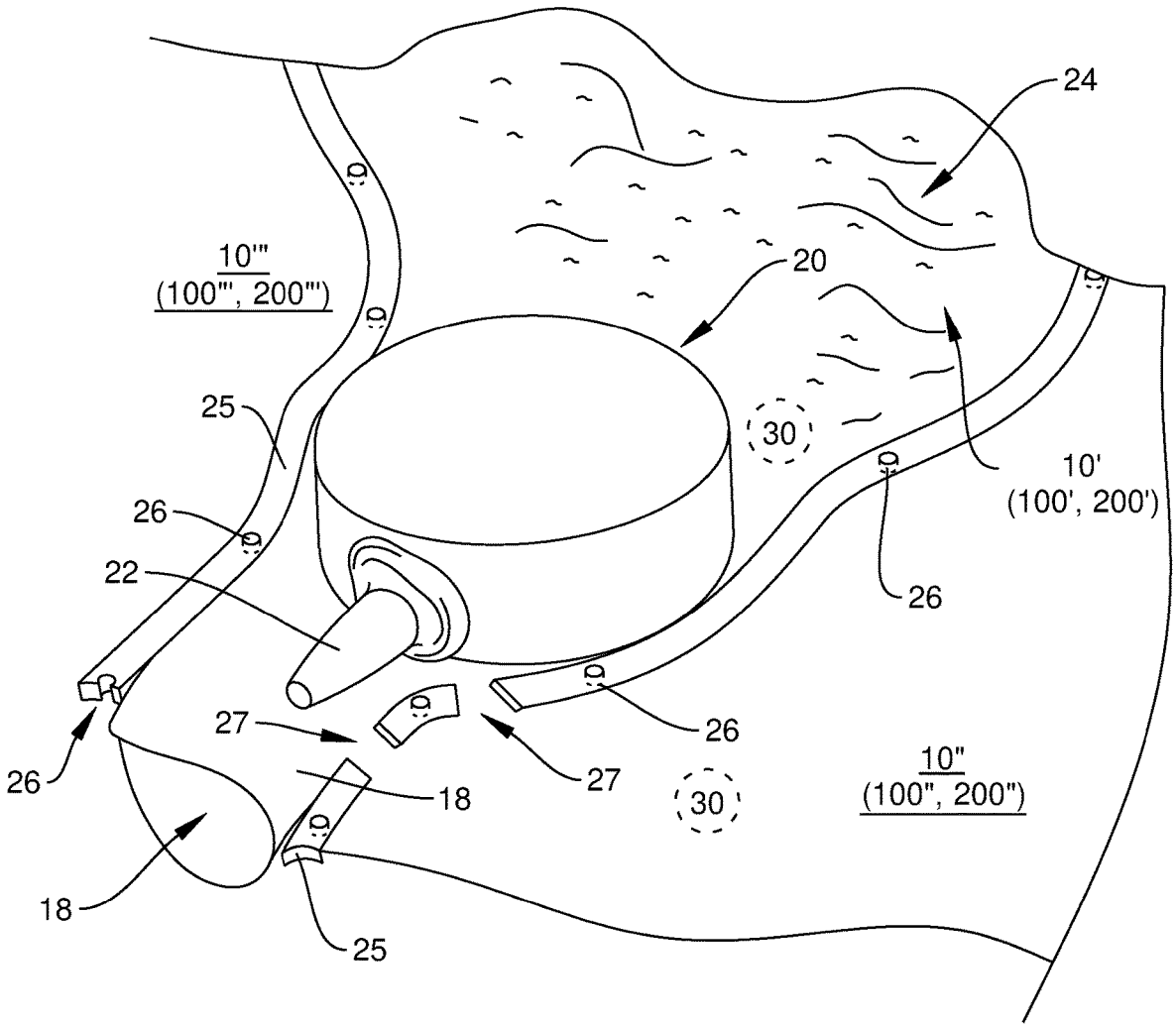
FIG. 4 illustrates one embodiment of an air filter.

FIG. 4 shows an optional filter, provided in an air channel associated with a padded cell (10', 100', 200'). This example illustrates a three-dimensional view of a porous filter (air diffuser) 20 provided with an inlet portion 22. The filter may be placed within an air channel 18 before entrance to a padded cell (10', 100', 200' etc.), so that the inlet portion 22 faces the air channel 18, and the porous filter body faces the padded cell. The filter 20 prevents clogging of the air channel 18 by fiber-like material 24 when evacuating air from the padded cell.

Every padded cell/pocket (10', 100', 200' etc.) has one or more openings in it, The cells may be connected in series (somewhere by air channels like 18 to connect them with the inflating unit 11), so the air may pass from one cell to another and when deflating one, it will eventually deflate all the pockets (all the garment). As mentioned above, the padded cells may be connected in parallel, i.e. may communicate by air with more than two neighboring cells.

Every "junction" between the air channels/cells may be fitted with a hollow tube like a piece of straw to keep the junction from collapsing and clogging the air passage.

Each padded cell/pocket may be fitted with one or more air diffusers, for example like the air filter/diffuser 20 shown in this figure.

The porous material of 20 allows air to flow in any direction through the diffuser, and is not likely to get clogged by the fiber-like filling.

The air diffuser may comprise only the porous body (for example, if it is placed between adjacent padded cells).

Hermetic seams 25 may be provided between the cells around the air channels 18, so as to divide adjacent cells 10' (100', . . . , 10"(100". . . ), 10'" (100'". . . ). Further, orifices 26 for ventilation may be provided in the hermetic seams 25, which serve as outlets for humid air if accumulated beneath of the garment.

Alternatively or in addition, at least one humidity sensor 30 may be located under the garment.

It should be noted that seams of the inflatable item may be hermetic or non-hermetic for padded cells adjoining a specific seam from its different sides. For example, the seam 25 may have gaps 27, owing to which the seam becomes non-hermetic for adjacent cells 200'. The gaps 27 help to improve air distribution among a group of cells, not only among those connected in sequence. Each specific seam may therefore be at least partially hermetic—in other words, its hermeticity may change along the length of the seam so that the seam may be hermetic for one pair of neighboring cells, and be non-hermetic for another pair of adjacent cells adjoining the seam from different sides thereof.

Figure 5:
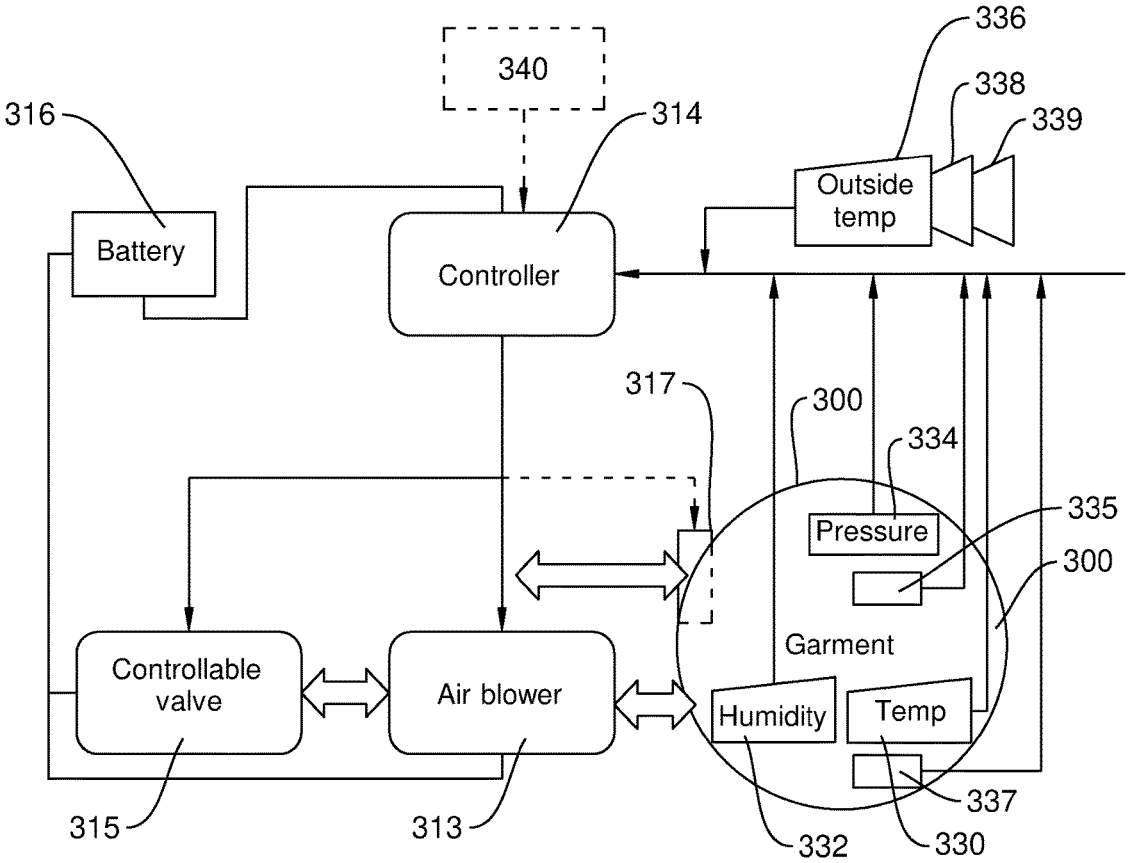
FIG. 5 shows a simplified block diagram of the proposed inflatable item.

FIG. 5 is a simplified block diagram of the proposed controllably inflatable item generally marked 300 (in this example, a garment). Preferably, all the blocks of FIG. 5 are embedded in the item. For example, a control unit 314 is a microcontroller. Block 314 is fed by a battery 316 which also feeds a controllable valve 315 and a controllable air pump (blower) 313, which works either as air evacuating or as an air inflating pump, depending on the control signals from block 314.

Alternatively or in addition, the garment may be provided with an air valve 317 which may be operated by the user directly. Optionally, the control unit 314 may be adapted to control the valve 317.

The garment 300 is inflatable and deflatable via air channels (not shown). Direction of the air to-from the garment cells is illustrated with three thick two-directional arrows.

The garment 300 may be equipped with internal sensors for detecting parameters under the garment: a temperature sensor 330, a humidity sensor 332 and an air pressure sensor 334 for indicating the current air pressure in the garment cells. Optionally, a movement sensor 335 and a pulse/blood pressure sensor 337 may be provided for estimating physical activity of the user. Such sensors may communicate with the control unit 314. An external outside temperature sensor 336 may be provided on an external portion of the garment. Optionally, an outside air humidity sensor 338 and an outside air pressure sensor 339 may be provided and used. All the internal and external sensors may transmit their readings to the control unit 314 wirelessly.

Based on the readings of the sensors 330, 332, 334, 335, 336, 337, 338, 339 etc. and on the settings which include personal settings of the user (at least the desired temperature under the garment) or direct user's commands, the control unit 314 processes the received information and provides control signals for inflating the garment, for deflating the garment or for keeping the current status.

The control unit/system may be more advanced and comprise functions of artificial intelligence (AI), for example may perform machine learning to create the user's profile. For example, the control unit 314 may decide that the user is hot when the internal temperature and/or internal humidity is higher than the user's preference. However, 314 may decide that the user is hot or will be hot when the inside temperature and/or humidity increases or when the physical activity is greater than a known standard for the user. Such a standard may be learned in advance, for example by machine learning during specific time slots of the user's regular day, and may be then stored and further used for updating the user's settings, the user's profile, etc.

The control unit 314 may decide that the user is cold or will be cold, when the internal temperature is less than the user's preference and/or when the user's pulse, blood pressure and/or physical activity is lower than usual.

The settings usually relate to the user's preferences or default values and may be entered into the control unit 314 either directly, or via Bluetooth/WiFi, using a remote control unit, for example a computer or a mobile phone application (schematically marked as 340). In response to the decision ("cold" or "hot") of the control unit 314, the air may be introduced (I) into, or evacuated (D) from the garment's cells padded with a padding material, for example via hermetic air channels (not shown in this drawing).

If the decision of 314 is "OK", the garment will neither be further inflated, nor be deflated, but the cycle will repeat from analysis of all the data after a delay of some time (for example, some minutes).

Figure 6:
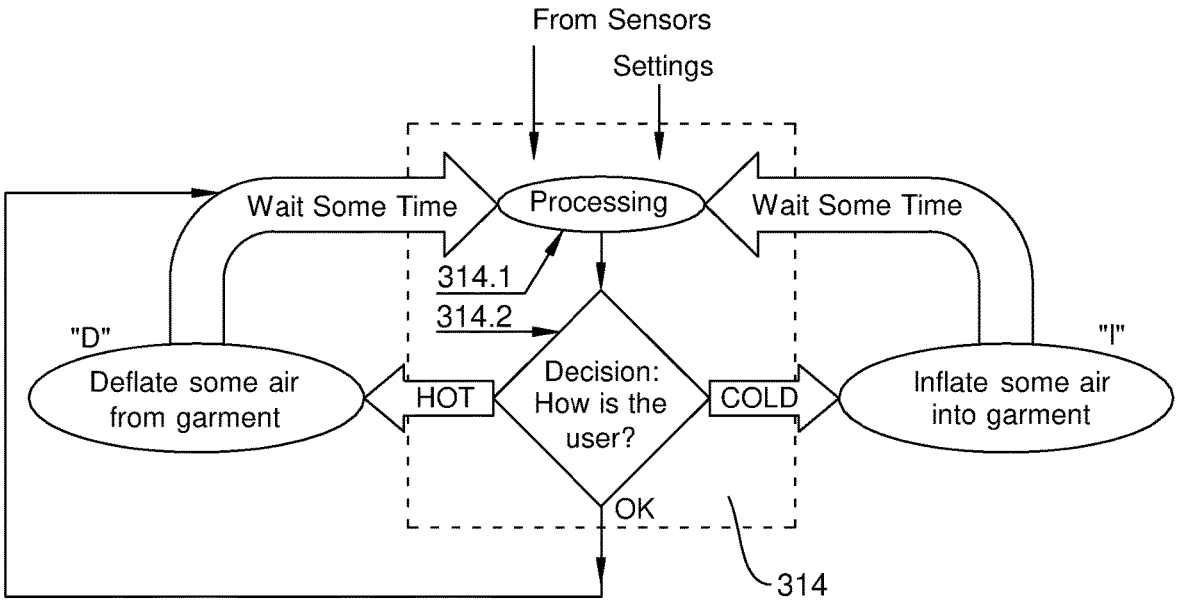
FIG. 6 shows a simplified flow-chart illustrating one version of the method for controlling the proposed inflatable item.

FIG. 6 shows a simplified flow-chart of controlling the proposed inflatable item (for example, a garment) by the control unit 314. The block of controller 314 and its sub-units 314.1, 314.2 schematically represent operations performed in the control unit of the garment. The control unit 314 receives input data: readings from sensors: 330, 332, 334 335, 336, 337, 338, 339 and possible other ones, and also receives and stores the user's as well as the manufacturer's Settings.

Basically, the settings comprise at least the user's preferred temperature under the garment (the inner temperature). The settings may also include values of inner humidity, pulse and/or blood pressure, degree of physical activity, etc. accepted as normal/maximal for the user, maximal value of air pressure allowed in the garment cells, etc. It should be noted that Settings may include direct commands of the user. As mentioned, the settings may be entered into the control unit 314 directly or wirelessly.

Block 314.1 performs operations of collection and processing of the input data and the user's settings, and a logical block 314.2 makes a decision whether the user is hot or cold. For example, the control unit considers that the user is cold if the inside temperature is less than of about 21° C. which is the user's preference. If the internal pressure measured by the sensor 334 may still be raised, the control unit will issue a control signal to pump some air into the garment cells (to inflate the garment). The pump 313 may be activated automatically. A valve 317 may be activated either manually or automatically. Upon inflating the cells padded by the fibrous filling, the garment is expected to increase its thermal insulation. The processor 314 will update the received data on the temperature and the humidity again in some predetermined period of time (for example, in a few minutes). The time period may be predetermined in advance, in the user's settings, and may be regulated if necessary.

In some time the processor 314 may re-analyze current readings of the sensors 330, 332, 334, 335, 336, 337 and decide that the user is hot. For example, the temperature inside (under) the garment has occurred to be greater than 21° C.; moreover, even humidity inside the garment may be greater than a default value. In this case, the control unit 314 will send a control signal to evacuate some air from the garment cells (to deflate the garment). According to that signal, some air may be released from the garment to make it thinner, i.e., less heat insulating. The deflating operation may be performed manually or automatically, via the valve 315 and/or 317. If the user's status is considered OK (the internal temperature/humidity are kept according to the settings), the control unit 314 will not issue commands for a while.

Any current status will be re-checked after some predetermined period of time.

It should be noted that more information may be taken into account by the control unit/system of the proposed item, for making prognoses and decisions in advance. For example, the control system (e.g., its software product) may be designed to have some functions of artificial intelligence: a pattern of physical activity of the user may be studied in advance, outside weather conditions (temperature, humidity etc.) may be estimated in advance, and a pattern of controlling the garment during a specific day may be prepared in advance. Of course, the control pattern prepared in advance may be adjusted in real time, based on current data received by the control system from the internal and external sensors, for example based on a non-typical physical activity of the user, non-typical inside temperature and/or non-typical readings of pulse/blood pressure which may together mean (for example) that the user is sick. In such a case the prepared heat insulation regime will be adjusted and even an alarm may be issued to the user. Some more advanced control systems will be shown in FIGS. 7-9.

Figure 7:
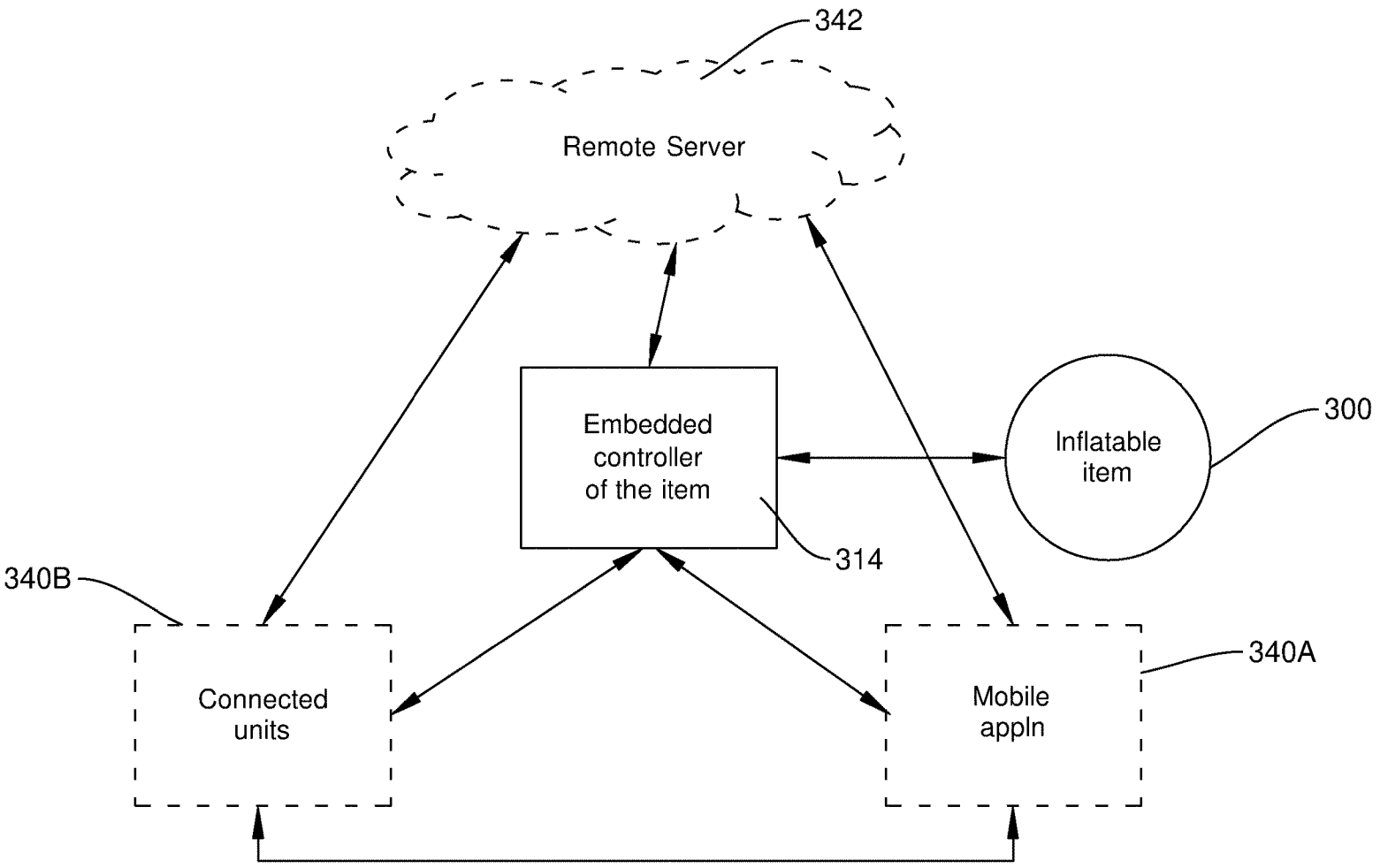
FIG. 7 illustrates one exemplary embodiment of a control system for the proposed inflatable garment.

FIG. 7 illustrates possible configurations of the control system of the proposed inflatable item. The control system always comprises a basic control unit which, in this case, ensures control of a controllable air valve via a controllable air pump of the proposed item/garment (10, 100, 200, 300), (the valve and the pump are not shown). The basic control unit and the controllable item/garment are shown in solid lines. Optional units are shown in dashed lines (actually, all the units except for the controller and the garment are shown in dashed lines).

In FIG. 7, the basic control unit is shown as the embedded controller 314 for controlling inflation/deflation of the garment 300. The controller 314 may collect some data from the garment directly (for example, the temperature and optionally the humidity under the garment). Optionally, the controller 314 may collect and exchange some data via an interface formed by software application(s) 340A and other connected units 340B.

The controller 314 may process the collected data itself, but may delegate it, at least partially, to a remote server such as a Cloud server 342.

For example, a Mobile application 340A may be used for collecting data from outside sensors, and for communication between the user and the embedded controller 314. The connected unit 340B may be in the form of a smart watch, a cellphone camera or the like.

The connected units 340A, 340B (e.g., a Smart phone with application, a Smart watch, a cellular camera, etc.) are capable of obtaining and/or measuring inside and outside parameters (for example, pulse, blood pressure, temperature, movement activity of the user, movement pulse and blood pressure, changes in the user's behavior, signs of fatigue in the eyes and face of the user, as well as humidity and temperature inside and outside of the garment, pressure inside cells of the garment) and for communicating the information to the embedded controller 314.

The interfacing units 340A and 340B (the connected units as listed above) may optionally be also interconnected with one another for processing the data collected from various sensors and by themselves.

Communication within the control system may be performed using cellular or WiFi communication techniques.

The control system of the proposed inflatable item/garment may have functions of Artificial Intelligence (AI). For example, the Controller installed in the item may include an embedded software program. The program may be capable of machine learning of the individual user from the point of his/her regular regime based on values of temperature, pulse of the body and temperature of the surrounding in specific hours, on usual physical exercises, etc. Based on the regular regime, the basic mode may be built which may be then adjusted by random changes of the regime and various factors.

The Controller may incorporate elements responsible for communicating with various detectors and sensors, both local and external, and elements capable of communicating with interfaces and/or a cloud. The AI software may be distributed between different functional blocks of the system and may make decisions to perform some changes in heat insulation in advance, in a smooth manner and based on the learned data about a specific user and the current data about this user (for example, the user may be trained, untrained, sick, etc.). The AI functions are characterized by smooth changes in the heat insulation, by taking actions in advance and prolonging the reactions so as to predict and precede sharp changes in the regime to make them smooth. For example, if the user runs, the AI-assisted changes may be made in advance gradually and may be kept longer than the run lasts, by decreasing the changes also gradually.

Figure 8:
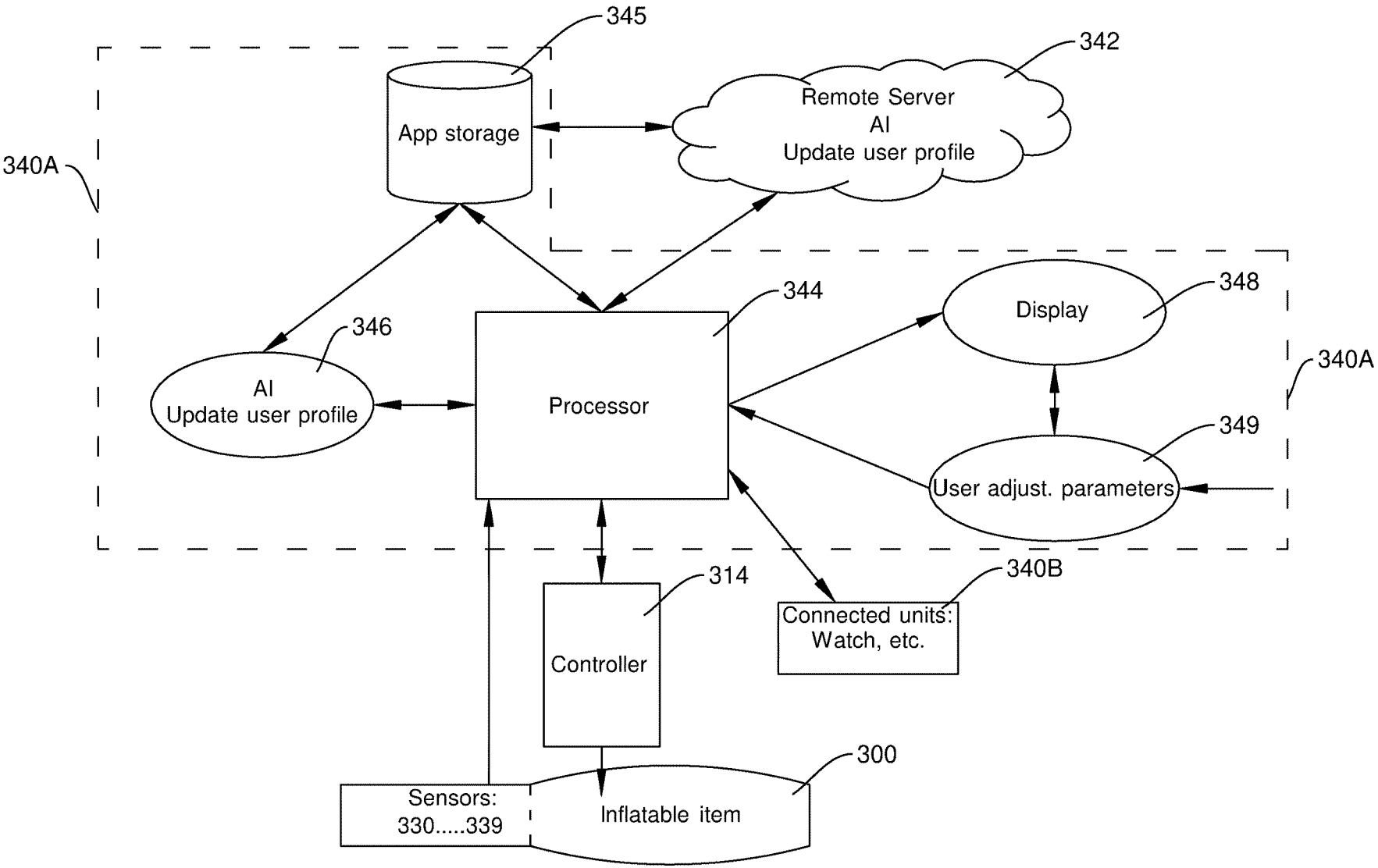
FIG. 8 illustrates another exemplary embodiment of the control system.

FIG. 8 shows one modification of the control system in more details, by illustrating some Artificial Intelligence (AI) functions of the mobile application 340A.

In this drawing, the dashed contour 340A indicates the mobile application which comprises:

- a processor 344 for
  - a) collecting data from, for example, sensors 330-339, controller 314, connected units 340B, server 342 and
  - b) processing the collected data;
- an application storage 345 in communication with the Remote server 342 and with the processor 344 (for storing current measurements' readings, the user's profile and possible current changes from nominal values of the profile, for example when the user is tired).

The processor 344, based on the collected and processed data, may:

- update the user's profile (see 346) for storing the updates in the processor itself and/or in the applications storage
- display (see 348) important parameters or alarms to the user,
- receive and handle (see 349) parameters updated by the user, as well as the user's commands.

For example, the application storage 345 may store various heat insulation control patterns, created based on learning (say, machine learning) of various parameters and the user's behavior during different seasons and different days of the week, for different patterns of physical activity.

On the other hand, when the user's behavior or health changes, the control system may dynamically update its patterns accordingly and in advance.

The control system, for example the control system with Artificial Intelligence (AI) elements, may be used for leaning and processing of the collected data, for example for updating the user's profile (346) and/or for controlling the inflatable item based on the user's profile and the collected data.

The user's profile may be created with the following attributes: temperature desired by the user, humidity preferred by the user, activity normally performed by the user etc.

The user's profile 346 may have the ability to figure/determine variations from the created profile and adjust the garment to the specific needs of the user, while sharp changes will be smoothened.

As in the previous figure, controller 314, sensors 309-339, inflatable garment 300, connected units 340B and remote server 342 are shown, with their intercommunication with the mobile application 340A.

Figure 9:
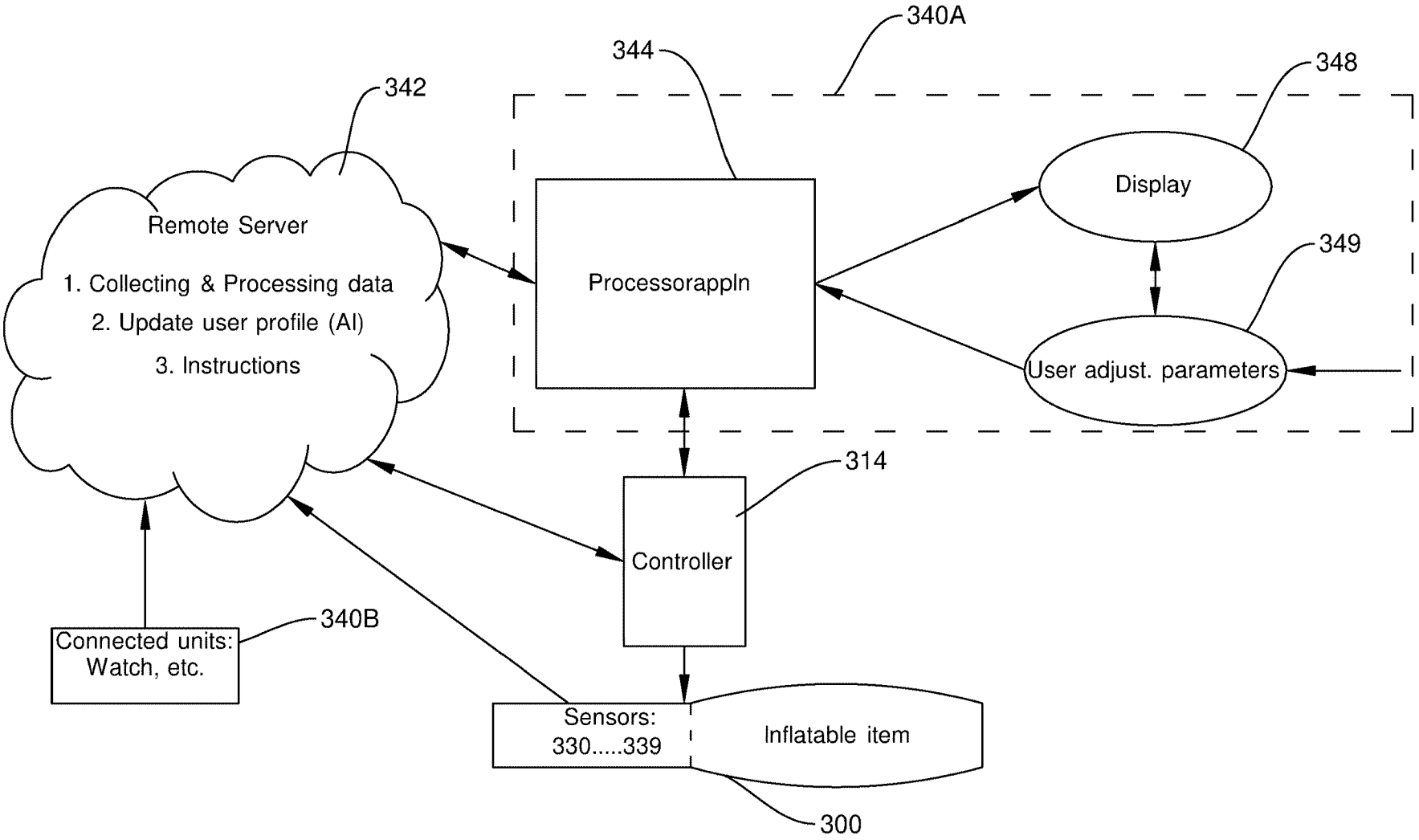
FIG. 9 shows yet another exemplary embodiment of the control system.

FIG. 9 illustrates a slightly different version of the control system, built using the principle of Internet of Things (IoT).

In this version, the Remote server 342 is in direct communication with "all the Things": with Controller 314, with Mobile application 340A, with Sensors 330-349, with Smart watch 340B, etc.

The Remote server 342 may operate online, using cellular, Bluetooth or WIFI techniques for collecting the necessary data from all the directly connected blocks, processing the collected data and providing the controller 314 with control instructions. Other units may also be in bidirectional communication with the server 342 and may receive updates there-from.

The Remote server 342 may update the user's profile online or offline, when possible.

The user's profile may be used for further intelligent control of the garment.

As can be seen here, not only AI, but also IoT elements may enrich functions of the control system.

The Remote server 342 may collect and store data and knowledge about the user and then, based on the stored data & knowledge may use current readings of the sensors, so that the IoT software may produce and send to the user's attention some information about his/her current condition. For example, such information may indicate that the user is trained or untrained, unusually weak, unusually cold or hot, has unusual pulse with or without movements, has some signs manifesting sickness, etc. Such information may be sent to the user's smartphone application, for example, and may be used for updating and storing the user profile.

In other words, the control system may comprise at least an embedded controller (microprocessor), but may also include additional control units such as a remote server and/or interface units like a mobile application and/or a smart watch which are designed to communicate with sensor (s) and with one another.

Functions of the control system always comprise basic ones, but may comprise some advanced ones. The above-described examples of the control system are capable of:

- collecting readings from sensors, at least on the internal temperature between the garment and the user,
- processing the readings collected from the sensor(s) together with information on default/threshold values of the readings (which may include both inside and outside readings and thresholds),
- receiving additional data from various interface devices (such as a smart watch, a smartphone mobile application, etc.)
- processing all the received data for improving the picture about the user and the surroundings,
- activating the inflating/deflating unit in order to change the current status of the heat insulation so as to adjust it to the user's needs;
- reporting the data and the actions of the inflating/deflating unit to the user (say, via display of the mobile application);
- storing the data and the actions taken in the current case to update the user's profile and predict actions of the system in future in similar circumstances.

For example, the control system may further be capable of acting in advance to prevent sharp changes in thermal insulation and/or to prolong effect of the changes after being made, so as to smooth changing needs of the user.

While the present invention has been described with reference to specific embodiments and has been illustrated by specific drawings, it should be appreciated that other embodiments of the inflatable item and other versions of controlling volume of its cells may be proposed and respectively illustrated, and that such embodiments and versions should be considered part of the invention whenever defined by the claims which follow.

The invention claimed is:

1. A system comprising:

an inflatable item comprising one or more cells containing a padding material;

a pump connected to said one or more cells to inflate and/or deflate said one or more cells;

at least one temperature sensor providing an output signal; and a control unit receiving said output signal from said sensor and providing a control signal to said pump based on comparison of said output signal to a predetermined threshold temperature, so as to regulate a thermal insulating property of the one or more cells.

2. The system according to claim 1, having at least one air valve.

3. The system according to claim 2, wherein said at least one air valve is controlled by said air pump for inflating and/or deflating a garment.

4. The system according to claim 1, being selected from a non-exhaustive list comprising: clothing, headwear and footwear items such as coats, vests, pants, overalls, hats, gloves, scarfs, socks, boots and the like, and comprising other items for keeping a user in temperature comfort, such as blankets, mattresses, sleeping sacks, tents and the like, and elements thereof.

5. The system according to claim 1, wherein the padding material comprises at least one member of the group consisting of natural fibers, artificial fibers, natural down, artificial down, plume, feathers, natural fabric flock, artificial flock, and foam.

6. The system according to claim 1, provided with air channels for conveying air to and/or from the cells.

7. The system according to claim 1, further provided with one or more air filters for preventing expel of the fiber-like material from the cells.

8. The system according to claim 1, comprising orifices for evacuating humid air from a space between the item and a supposed user, to keep the user dry.

9. The system according to claim 8, wherein the orifices are located in seams of said item.

10. The system according to claim 1, wherein at least partially hermetic seams are provided between said cells.

11. The system according to claim 10, wherein said seams are associated with air channels provided in the item between the seams.

12. The system according to claim 1, comprising one or more additional sensors selected from the group consisting of an inside humidity sensor, a sensor of the user's pulse, an outside temperature sensor, an outside humidity sensor, an air pressure sensor inside at least one of said one or more cells, each of said at least one or more sensors providing an additional output signal to said control unit, wherein said control unit is programmed with predetermined threshold values for each of said additional output signals so that the control unit produces control signals taking said one or more additional output signals and said threshold values into account.

13. The system according to claim 1, wherein the control unit comprises at least one member of the group consisting of a software application, a smart watch, a remote server being designed for collecting and processing said one or more sensor output signals relative to said predetermined threshold values of said additional readings, and wherein parts of said control unit are in communication with one another.

14. The system according to claim 1, wherein the control unit is adapted to learn and process collected data for creating and updating a user's profile and/or for controlling the inflatable item based on the user's profile and the collected data.

15. The system according to claim 14, wherein the user's profile is created with at least the following attributes: temperature desired by the user, humidity preferred by the user, physical activity normally performed by the user, and wherein the control system is adapted to detect variations of the collected data from the created user's profile and to adjust said inflatable item to the specific needs of the user.

16. A method for regulating thermal insulating property of an item comprising one or more cells provided with a padding material, the method including controllably inflating and/or deflating said item by controllably changing volume of air accumulated in said padded cells in response to output signals from one or more sensors.

17. A software product comprising computer implementable instructions and/or data for carrying out the method according to claim 16, stored on an appropriate non-transitory computer readable storage medium so that the software is capable of enabling operations of said method when used in a computerized system.

18. A computer readable storage medium storing the software product according to claim 17.

* * * * *